US005587633A

United States Patent [19]

Aoki et al.

[11] Patent Number: 5,587,633

[45] Date of Patent: Dec. 24, 1996

[54] PRESS CONTROL METHOD AND PRESS APPARATUS

[75] Inventors: Hideji Aoki; Takahiro Tashima; Suekazu Nakashima; Yoshiyuki Osako; Hidetaka Yamasaki, all of Tokyo, Japan

[73] Assignees: Mitsubishi Denki Kabushiki Kaisha; Mitsubishi Electric Engineering Co., Ltd., both of Tokyo, Japan

[21] Appl. No.: 578,970

[22] Filed: Dec. 27, 1995

[30] Foreign Application Priority Data

Feb. 23, 1995 [JP] Japan ..... 7-035368

[51] Int. Cl.[6] ..... B21D 5/02

[52] U.S. Cl. ..... 318/164; 318/162; 318/569; 318/626; 318/430; 72/20.1

[58] Field of Search ..... 318/569, 600, 318/601, 603, 604, 626, 632, 634, 162, 163, 164, 430, 434; 29/432, 432.1, DIG. 37; 72/6, 10, 13, 21; 100/48, 50; 234/13, 20

[56] References Cited

U.S. PATENT DOCUMENTS 3,596,266 7/1971 Slawson et al. .
3,825,811 7/1974 Smith et al. .
3,987,283 10/1976 Moeller .
4,314,185 2/1982 Schneider et al. .
5,115,735 5/1992 Gloe et al. .

*Primary Examiner*—Bentsu Ro
*Attorney, Agent, or Firm*—Oblon, Spivak, McClelland, Maier & Neustadt P.C.

[57] ABSTRACT

It is an object to obtain a press apparatus and a press controlling method which apply press working to a processed object with accurate press load and is capable of press working with accurate press load without affected by variations in thickness of the processed objects and variations in shut height of molds. A servo motor (51) is connected concentrically to a rotation transmitter (52), and a screw shaft (53) is provided passing through the center of the rotation transmitter (52). The driving force of the servo motor (51) is converted into a thrusting force of a press ram (54) by combining the rotation transmitter (52) and the screw shaft (53). Correct press load is applied to the processed objects and troubles in the press processing caused by variations in thickness of the processed objects can be prevented.

12 Claims, 10 Drawing Sheets

PRESS CONTROL METHOD AND PRESS APPARATUS

BACKGROUND OF THE INVENTION

1. Field of the Invention

The present invention relates to press control methods and press apparatus, and more particularly to a press control method and a press apparatus capable of processing lead frames of semiconductor devices which requires high accuracy.

2. Description of the Background Art

In punching processing of lead frames of semiconductor devices with resin-sealed semiconductor integrated circuits and forming processing of leads, hydraulic, or more particularly, oil hydraulic press apparatus have been widely used. The oil hydraulic press apparatus can obtain a constant pressurizing force easily and stably, so that it is effective also in processes which require fine processing, such as of lead frames.

In recent manufacturing methods of semiconductor devices, with increasing requirement for precise products, the press work is performed in clean working circumstances, such as in a clean room. However, the problem of dusts, oil mist, etc. produced by the oil hydraulic press apparatus, and the problem in the industrial hygiene such as deterioration of working circumstances due to noise, such as pump noise, impact sound of molds, etc., are now being actualized. Accordingly, press apparatus of the motor driving system, instead of the oil hydraulic system, have been developed recently.

For example, Japanese Patent Laying-Open No. 1-316240 discloses a structure which uses a servo motor as a driving source for a mold clamping mechanism, in which the rotation force of the servo motor is used as a thrusting force to a movable platen to open/close and clamp the mold. In this apparatus, a plurality of position detectors are arranged along a moving direction of the movable platen to control the rotation direction, the number of rotations (speed), the torque (current), etc. of the servo motor according to positions of the movable plate, where a force holding device operates when torque set for mold clamping is reached to maintain the mold clamped state and the servo motor is opened.

In the mold clamping method disclosed in Japanese Patent Laying-Open No. 1-316240, as the servo motor clamps the molds with certain speed, it may not be able to correctly stop at the set torque even if the force holding device works when the set torque is achieved (at the time when strong mold clamping is finished). This is due to the fact that the motor continues operating while producing torque, so that fine rotation is always caused by mechanical displacement at the time of mold clamping.

Also, the fact that the servo motor does not stop at the set torque even if the force holding device works means that an electrical and mechanical slight lag time occurs and the set torque is exceeded, which will result in a factor of preventing mold clamping with high preciseness.

Furthermore, the structure disclosed in Japanese Patent Laying-Open No. 1-316240 has a long and complicated transmission system from the servo motor to the movable plate, which will produce a problem of occurrence of mechanical loss due to backlash, twist of a driving shaft, etc. in this system.

Also, as another example, Japanese Patent Laying-Open No. 4-309413 shows a structure in which a motor is coupled to a shank through a pressure sensor, in which the rotation force of the motor serves as a thrusting force to a holder of the mold and the punch of the mold presses a processed object. In that structure, a maximum press force to be applied to the processed object from the mold is stored in a storage portion in advance, and when forming the processed object with the mold, the punch descending at certain speed is stopped when a signal sensed by the pressure sensor reaches the maximum press force.

In the press apparatus disclosed in Japanese Patent Laying-Open No. 4-309413, however, even if the operation of the motor is stopped at the time when the set maximum press force is achieved to stop the punch going down at certain speed (motor rotation), it is impossible to stop the punch having the inertia energy correctly at that position without any time lag, and a press force will be exerted over the set value. Further, in the time from when the pressure sensor makes detection until when the motor stops operating, though which is a very short time, the motor is operating to exert a press force over the set value.

In the conventional press apparatus of the motor driving system, which are constructed as described above, the pressing operation can not be stopped correctly when the set conditions are achieved, and mechanical loss is apt to occur because of backlash, twist of the driving shaft, and the like in the long and complicated transmission system of the driving force from the motor. For example, there is a problem that the conventional press apparatus of the motor driving system can not satisfy the requirement for accuracy on the order of μm in processing of lead frames of recent miniaturized semiconductor devices.

SUMMARY OF THE INVENTION

A first aspect of the present invention is directed to a press control method for a press apparatus which converts a driving force of a motor into a thrusting force of a mold through driving force—thrusting force converting means directly connected to the motor to press a processed object. According to the present invention, the control method comprises the steps of: (a) detecting a change in a torque value of the motor when pressing the processed object and determining whether a previously set predetermined torque value smaller than a target rated torque value is reached or not; and (b) after reaching the predetermined torque value, counting the quantity of drive of the motor, comparing deceleration pattern which is previously set as a function of speed and the quantity of drive and the counted quantity of drive of the motor and decelerating a thrusting speed of the mold on the basis of a speed instruction applied according to the quantity of drive of the motor so that the thrusting speed of the mold attains zero at the time when the quantity of drive of the motor achieves a previously set predetermined quantity of drive.

Preferably, according to the press control method of a second aspect of the present invention, the deceleration pattern is a sine curve.

Preferably, according to the press control method of a third aspect of the present invention, the predetermined quantity of drive is the quantity of drive of the motor made while the torque value of the motor reaches the rated torque value from the predetermined torque value, and which is a value for pressing ones with standard thickness in the processed objects having variation in thicknesses.

Preferably, the press control method of a fourth aspect of the present invention further comprises after the step (b) the step (c) of returning the mold to an initial position; the step (c) including the steps of decelerating the thrusting speed of the mold to a certain speed before the mold reaches the initial position, and stopping the mold at the time when the position of the mold moving at the certain speed is detected by initial position detecting means provided in the press apparatus.

Preferably, the press control method of a fifth aspect of the present invention further comprises the step of suppressing temperature rise of the driving force—thrusting force converting means attendant on the press processing of the processed object in parallel with the steps (a)–(c).

Preferably, according to the press control method of a sixth aspect of the present invention, the processed object is a lead frame which works as a terminal of a semiconductor device with a resin-sealed semiconductor integrated circuit.

A seventh aspect of the present invention relates to a press apparatus which converts a driving force of a motor into a thrusting force of a mold through driving force—thrusting force converting means directly connected to the motor to press a processed object. According to the present invention, the press apparatus comprises: torque value detecting means connected to the motor, for detecting a change of a torque value of the motor in the press processing of the processed object; torque value comparing means connected to the torque value detecting means, for making a comparison and determining whether the detected torque value is a previously set predetermined torque value which is smaller than a target rated torque value or not; drive quantity counting means connected to the motor for counting the quantity of drive of the motor; and controlling means connected to the torque value comparing means and the drive quantity counting means, for storing deceleration pattern previously set as a function of speed and the quantity of drive and comparing the quantity of drive of the motor outputted from the drive quantity counting means and the deceleration pattern to output speed instructions according to the quantity of drive of the motor so as to decelerate the thrusting speed of the mold, so that after reaching the predetermined torque value, the thrusting speed of the mold attains zero at the time when the quantity of drive of the motor achieves a previously set predetermined quantity of drive.

Preferably, the press apparatus according to an eighth aspect of the present invention further comprises initial position detecting means connected to the controlling means, for detecting whether the mold is at an initial position or not and feeding it back to the controlling means.

Preferably, according to the press apparatus according to a ninth aspect of the present invention, the driving force—thrusting force converting means has a thrusting shaft for providing a thrusting force to the mold, the mold being disposed on its center line, and the press apparatus further comprises temperature rise suppressing means for spraying gas maintained at a certain temperature to the thrusting shaft to suppress temperature rise of the driving force—thrusting force converting means.

Preferably, according to the press apparatus of a tenth aspect of the present invention, the motor is a torque motor which is driven by a pulse signal.

Preferably, according to the press apparatus of an eleventh aspect of the present invention, the initial position detecting means has a magnetic sensor sensing a magnetic force to sense magnetic field generated by a magnet provided to move as the mold moves to detect that the mold is at the initial position.

Preferably, according to the press apparatus of a twelfth aspect of the present invention, the initial position detecting means has an optical sensor having a light emitting portion and a light receiving portion for outputting a detection signal when light from the light emitting portion incident on the light receiving portion is interrupted, and detects that the mold is at the initial position when shielding means provided to move as the mold moves interrupts the light from the light emitting portion.

According to the press control method of the first aspect of the present invention, a change of a torque value of a motor attendant on the press processing of a processed object is detected to determine whether it has reached a previously set predetermined torque value smaller than a target rated torque value or not, and after that predetermined torque value is reached, the driving amount of the motor is counted, and the counted driving amount of the motor is compared with deceleration pattern previously set as a function of the speed and the driving amount to decelerate the thrusting speed of the mold on the basis of speed instructions provided according to the driving amount of the motor, so that the mold correctly stops at the time when the rated torque value is reached and it is prevented that the torque exceeding the rated torque value is applied to the processed object, and troubles in the press processing resulted from variations in thickness of the processed objects can also be prevented because the processing is finished when the previously set driving amount is achieved.

Accordingly, press processing can be performed with correct press load without affected by variation of thickness of processed objects and variation in the shut height of molds.

According to the press control method of the second aspect of the present invention, by controlling the motor so that the decelerating curve of the thrusting speed of the mold approximately draws a sine curve, the thrusting speed of the mold can certainly attain zero at the time when the driving amount of the motor attains a certain driving amount.

Accordingly, the press operation can be correctly stopped at the time when the set conditions are achieved.

According to the press control method of the third aspect of the present invention, as the certain driving amount is set to a driving amount of the motor made while the torque value of the motor attains the rated torque value from the predetermined torque value, and that value is set as a value for pressing ones with standard thickness of processed objects having variations in thickness, the certain driving amount has no difference even if the processed objects have variation in thickness, and therefore troubles in the press processing caused by variation in thickness of the processed objects can be prevented.

According to the press control method of the fourth aspect of the present invention, the thrusting speed of the mold is decelerated to predetermined speed before the mold reaches the initial position, and the mold stops at the time when the position of the mold moving at the predetermined speed is detected by the initial position detecting means provided in the press apparatus, so that the mold correctly returns to the initial position and troubles in the press processing caused by variation of initial position can be prevented.

According to the press control method of the fifth aspect of the present invention, by controlling the temperature rise of the driving force—thrusting force converting means caused in the press processing of processed objects, thermal expansion of the driving force—thrusting force converting means resulted from the temperature rise is suppressed and troubles in the press processing caused by thermal expansion of the driving force—thrusting force converting means can be prevented.

According to the press control method of the sixth aspect of the present invention, it can be applied to the case where the processed object is a lead frame which will serve as a terminal of a semiconductor device with a resin sealed semiconductor integrated circuit.

According to the press control method of the seventh aspect of the present invention, since the driving force—thrusting force converting means is directly connected to the motor, the transmitting path of the driving force from the motor is short and simple in structure, and since deceleration is achieved on the basis of the driving amount of the motor before the rated torque value is achieved from the predetermined torque value, it is prevented that the processed object is supplied with torque exceeding the rated torque value.

Accordingly, a press apparatus is obtained which is capable of press processing with correct press load without affected by variation in thickness of processed objects and variation in shut height of molds.

According to the press apparatus of the eighth aspect of the present invention, since it further includes initial position detecting means for detecting whether the mold is at the initial position or not, the mold can certainly return to the initial position and troubles in the press processing caused by variation of the initial position can be prevented.

According to the press apparatus of the ninth aspect of the present invention, it can be prevented that the thrusting shaft changes in length in the press processing to change press conditions for the processed objects by suppressing thermal expansion of the thrusting shaft of the driving force—thrusting force converting means.

According to the press apparatus of the tenth aspect of the present invention, since the motor is a torque motor and is driven by pulse signals, a large driving force can be obtained, and further, it is easy to count the driving amount, so that control by counting the driving amount can be made correctly.

According to the press apparatus of the eleventh aspect of the present invention, since the initial position detecting means has a magnetic sensor, a press apparatus can be obtained which prevents reduction of position detecting ability caused by vibration.

According to the press apparatus of the twelfth aspect of the present invention, since the initial position detecting means has an optical sensor, a press apparatus at low cost can be obtained.

The present invention has been made to solve problems described hereinbefore, and it is an object of the present invention to provide a press apparatus and a press control method capable of correctly stopping press operation at the time when set conditions are achieved, suppressing mechanical loss caused by backlash, twist of a driving shaft, etc. with a short and simple transmission path of driving force from a motor to apply press working with correct press load to processed objects, and performing press working with correct press load while not affected by variations in thickness of the processed objects and in shut height of molds.

These and other objects, features, aspects and advantages of the present invention will become more apparent from the following detailed description of the present invention when taken in conjunction with the accompanying drawings.

DESCRIPTION OF THE PREFERRED EMBODIMENT

<1. Structure of Apparatus>

Figure 1:
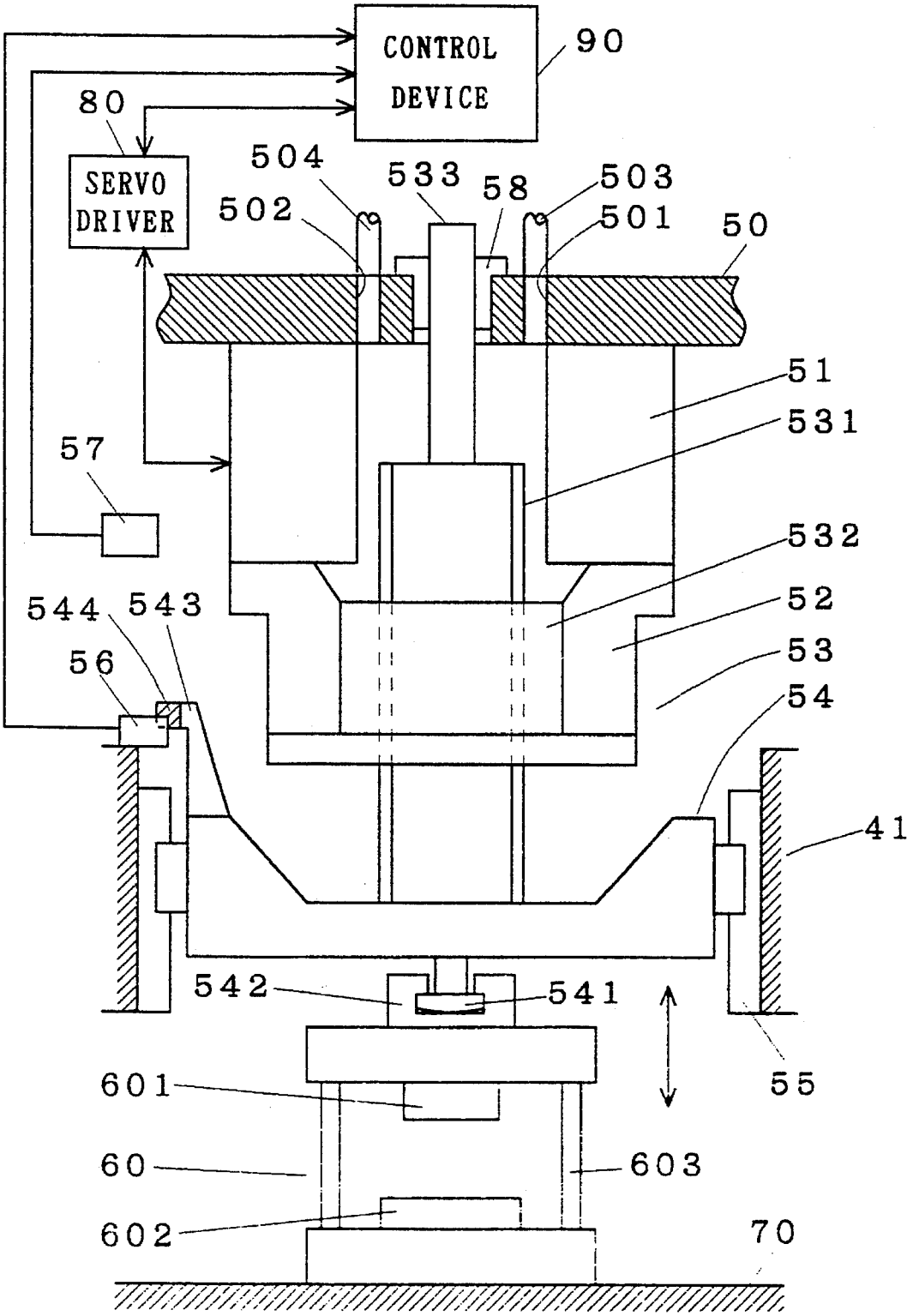
FIG. 1 is a diagram showing the entire structure of a press apparatus according to the present invention.

Referring to FIG. 1 through FIG. 10, a preferred embodiment of a press control method and a press apparatus according to the present invention will be described. First, FIG. 1 shows a diagram of the entire structure of the press apparatus according to the present invention.

In FIG. 1, a rotary servo motor 51 fixed to a mounting plate 50 for working as a press load generating source is concentrically connected to a rotation transmitter 52, and a screw shaft 53 is provided to pass through the center of the rotation transmitter 52. The driving force of the servo motor 51 is converted into a thrusting force for a press ram 54 described later by combining the rotation transmitter 52 and the screw shaft 53, so that the combination of the rotation transmitter 52 and the screw shaft 53 is referred to as a driving force—thrusting force converting means. Although not clearly shown in the figure, an encoder 511 is connected to the servo motor 51.

The screw shaft 53 is formed of a shaft 531, a nut 532 and a guiding shaft 533, and the shaft 531 having a thread, e.g. ball thread, formed thereon engages with the nut 532 fixed in the rotation transmitter 52 and receives rotation of the rotation transmitter 52 to move up and down. A screw thread is formed on the inside of the nut 532 to fit to the shaft 531, and it has a bearing ball in the screw thread so that the shaft 531 can slide smoothly.

A press ram 54 is connected to the lower end of the screw shaft 53, a guiding member 55 fixed to a mounting plate 41 is provided on both sides of the press ram 54, and the press ram 54 slides along the guiding member 55 to stably move up and down. A shank 541 is provided in the center of the lower end of the press ram 54, an end of which shank 541 is connected to a shank holder 542. Now, the servo motor 51 side is referred to as the upstream side and the shank 541 side is referred to as the downstream side.

A position detecting device 56 having a magnetic sensor for converting a magnet force into a voltage is fixed to the mounting plate 41. A magnet mounting plate 543 is attached to the edge of the upper end of the press ram 54, and a magnet 544 is attached to the end portion thereof. The positional relation between the position detecting device 56 and the magnet 544 is arranged so that the magnetic field produced by the magnet 544 can be sensed by the magnetic sensor of the position detecting device 56 when the press ram 54 is at an operation initial position. The use of the magnetic sensor for positional detection is advantageous in that the detection ability thereof is not liable to reduction caused by mechanical vibration and thus it is effective for press apparatus with vibration.

An origin detecting device 57 is provided on the upstream side of the position detecting device 56. The origin detecting device 57 is formed of an electric limit switch or the like for indicating that the press ram 54 is at the origin. The origin detecting device 57 may include a magnetic sensor like the position detecting device 56 to indicate the origin by sensing the magnetic field produced by the magnet 544. Now, the origin is also a limit point when the press ram 54 is raised to the limit to secure working space when exchanging the mold 60, described later, and in maintenance work, which may also be called an upper dead point.

Although the position detecting device 56 has a structure for indicating the operation initial position of the press ram 54 by sensing the magnetic field, it may have a structure for indicating the operation initial position of the press ram 54 with light shielding. That is to say, it may include an optical sensor having a light emitting portion for emitting light such as infrared light, laser light or visible light and a light receiving portion for outputting a voltage when the light is interrupted to indicate the operation initial position of the press ram 54 with interruption of the light. In this case, a shielding plate arranged so as to interrupt the light of the optical sensor at the operation initial position will be provided in place of the magnet mounting plate 543.

The advantage of the use of the optical sensor for positional detection lies in its relatively low cost. Although the detection ability is apt to be reduced by vibration, its price is about 1/10 as compared with a magnetic sensor, so that it is effective for a press apparatus with small vibration.

A straight movement guiding member 58 for holding the guiding shaft 533 so that it stably moves straight in up and down directions is attached to the mounting plate 50, and through holes 501 and 502 are provided around the straight movement guiding member 58. Pipes 503 and 504 respectively for introducing and exhausting gas are connected to the through holes 501 and 502.

The screw shaft 53, especially the shaft 531 is heated by generation of the Joule heat in press operation. The heating will expand the shaft 531 in the axial direction to displace the press ram 54. Accordingly, gas for cooling is introduced from one of the pipes 503 and 504 and exhausted from the other thereby to prevent expansion of the shaft 531.

The cooling gas may be air or nitrogen, and its temperature may be the normal temperature, or lower than that, as long as the temperature is constant. The cooling gas is supplied while being pressurized for effective introduction and exhaust.

The mold 60 is formed of an upper mold 601 and a lower mold 602 fixed on a mounting base 70 to face the upper mold 601, and the shank holder 542 is fixed on the upper surface of the upper mold 601. Accordingly, as the press ram 54 moves up and down, the upper mold 601 slides along a guide 603 provided between the upper mold 601 and the lower mold 602.

A servo driver 80 for driving is connected to the servo motor 51, and the servo driver 80 is connected to and controlled by a control device 90. Also connected to the control device 90 are the position detecting device 56 and the origin detecting device 57, where the position of the press ram 54 is fed back.

Although an example has been shown in which the rotary servo motor 51 is used as a press load generating source in the description above, it is not limited to a servo motor so long as it is a torque motor.

<2. Outline of Apparatus Operation>

Next, operation of the press apparatus according to the present invention will be described referring to FIG. 1. When the servo motor 51 normally rotates through the servo driver 90 on the basis of instructions from the control device 90, the rotation is transmitted to the rotation transmitter 52 directly coupled to the servo motor 51 and the nut 532 of the screw shaft 53 directly coupled to the rotation transmitter 52, and the shaft 531 descends, guided by the straight movement guiding member 58. As the shaft 53 1 descends, the press ram 54 descends, and the upper mold 601 coupled to the shank 542 descends. When the upper mold 601 descends to a predetermined position, the servo motor 51 attains forming operation, i.e. mold clamping speed, and further descends, and then the upper mold 601 and the lower mold 602 come in contact with each other with the processed object sandwiched therebetween.

When the upper mold 601 and the lower mold 602 come in contact with each other, the torque of the servo motor 51 increases and this torque value is added to the mold through the press ram 54 to work as press load to apply bending work to the processed object. After the bending work is finished, the servo motor 51 reversely rotates so that the upper mold 601 ascends, and it returns to the operation initial position and then stops. This is the outline of the press operation.

A control method of the press apparatus according to the present invention will now be described. First, FIG. 2 shows the structure of the control device 90 in a block diagram.

<3. Control Method>

<3-1. Structure of Control Device>

Figure 2:
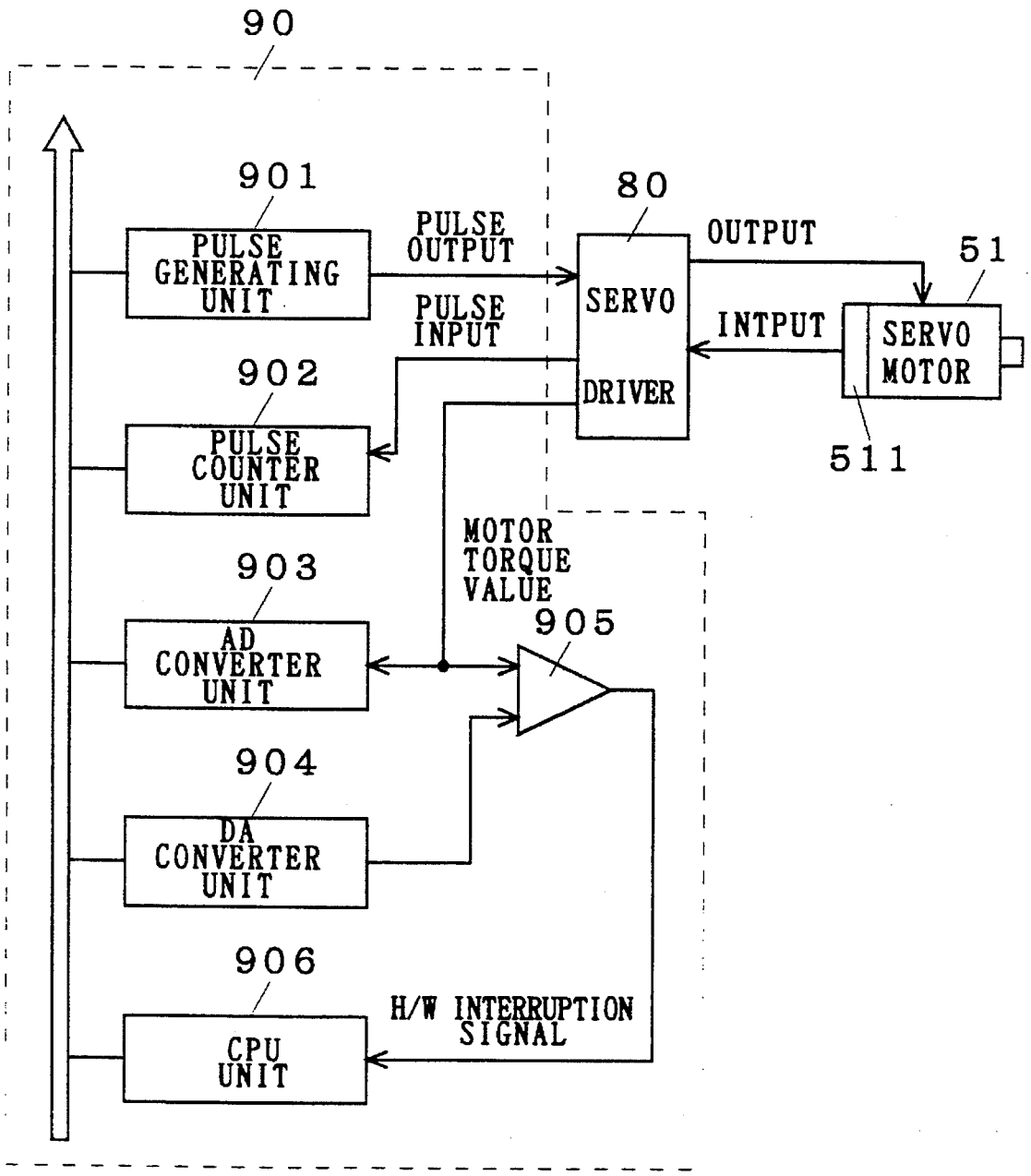
FIG. 2 is a diagram showing the control device of the press apparatus according to the present invention.

As shown in FIG. 2, the control device 90 includes a pulse generating unit 901 for generating pulse signal for driving to the servo driver 80, a pulse counter unit 902 for counting the pulse signal fed back from the encoder 511 connected to the servo motor 51, an AD converter unit 903 receiving a torque value of the motor applied from the servo driver 80 to AD convert the same, a DA converter unit 904 for DA converting previously set detection press load, i.e. a detection torque value, a comparator unit 905 for comparing the torque value of the motor and the detection torque value and a CPU unit 906 for storing set values and controlling the entire system.

Figure 3:
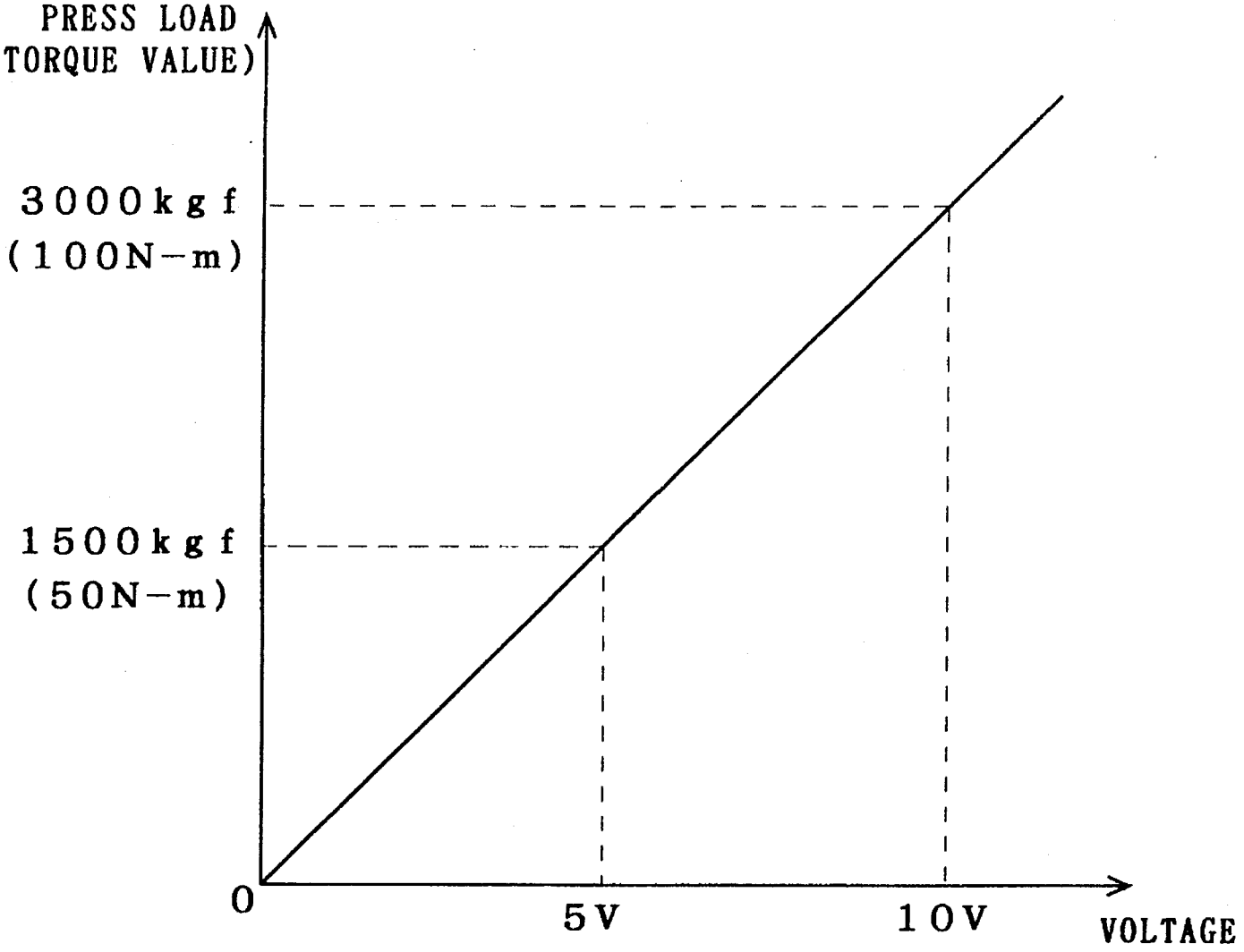
FIG. 3 is a diagram showing the correlation between the voltage of the servo motor and the press load.

Now, a description will be made on the detection press load, referring to FIG. 3. FIG. 3 is a diagram showing an example of the correlation between the voltage (or current) of the servo motor and the press load (motor torque value). As shown in FIG. 3, the voltage of the servo motor and the press load has relation of almost direct proportion (it is designed to have the relation of direct proportion), and this relation is input into the CPU unit 906 of the control device 90 in advance. At the same time, a predetermined press load is previously set on the basis of FIG. 3, which is input as the detection press load.

<3-2. Ordinary Control Operation>

Figure 4:
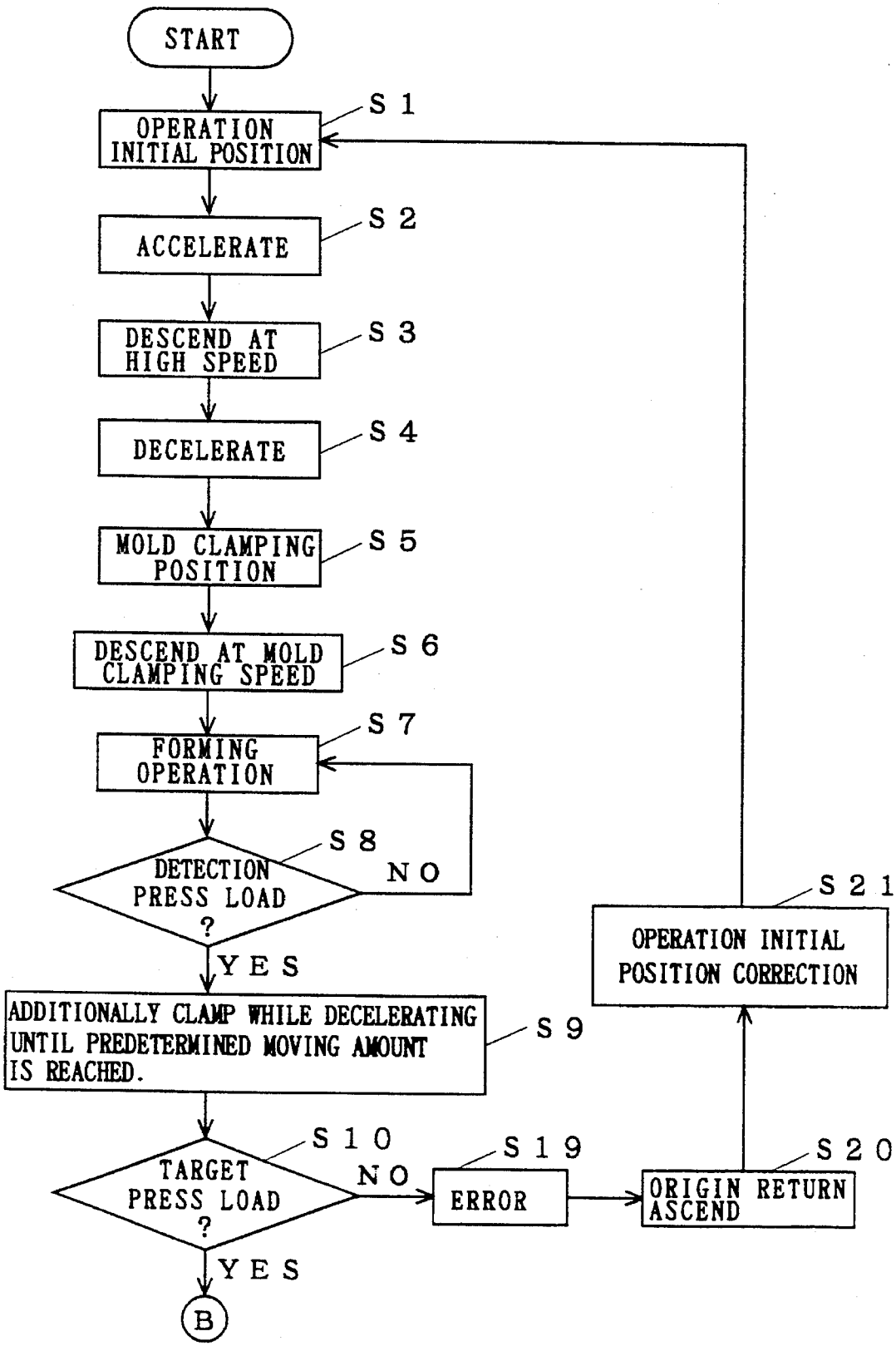
FIG. 4 is a flow-chart for illustrating a press control method according to the present invention.
Figure 5:
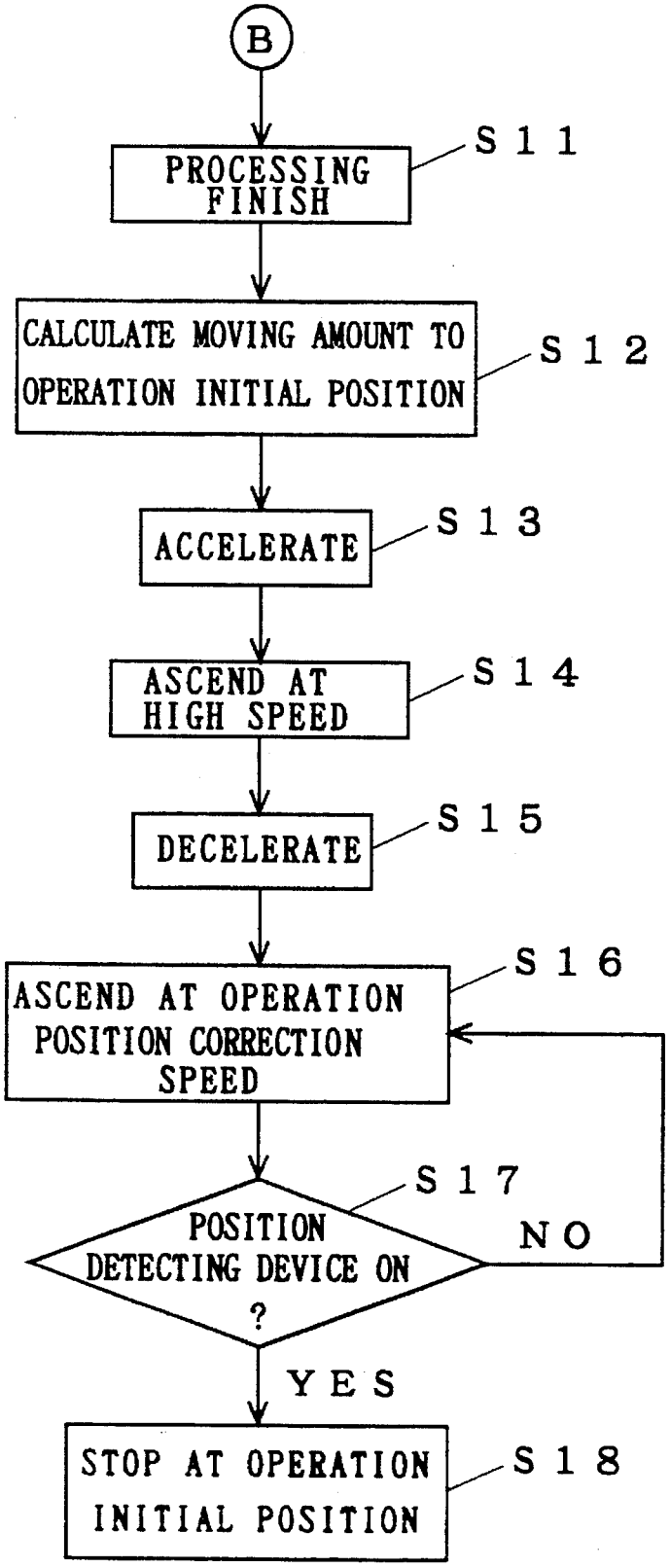
FIG. 5 is a flow-chart for illustrating the press control method according to the present invention.
Figure 6:
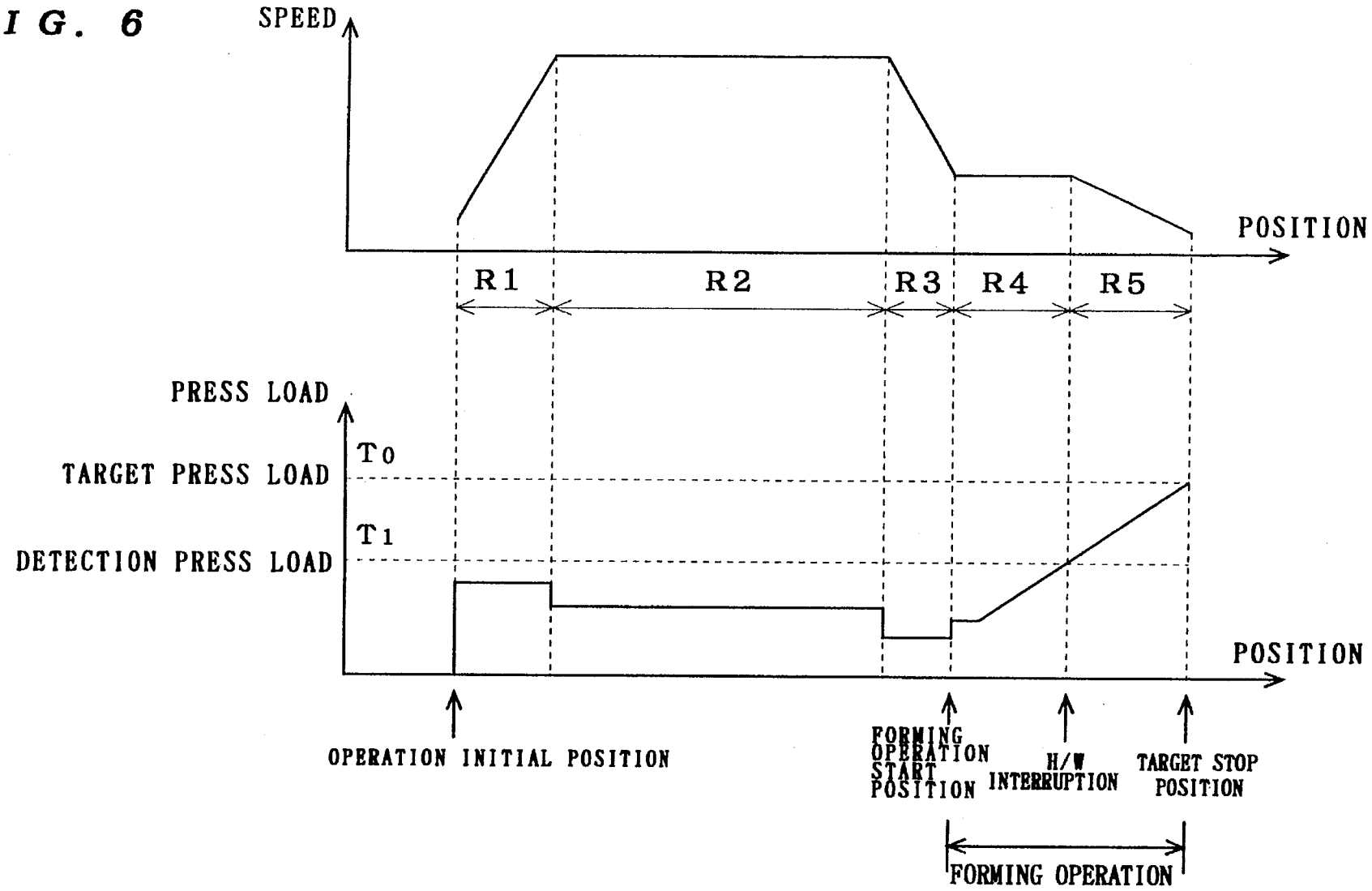
FIG. 6 is a diagram showing the relations between the position and the moving speed of the press ram, and between the position of the press ram and the press load of the press apparatus according to the present invention.

Next, the control operation will be described referring to FIG. 4, FIG. 5 and FIG. 6. Now, FIG. 4 and FIG. 5 show a flow chart illustrating the control operation, and FIG. 6 is a diagram showing the relation between the position and the moving speed of the press ram 54 and the relation between the position of the press ram 54 and the press load. The description will be made mainly on the operation of the press ram 54 for convenience, but the movement of the press ram 54 is directly linked with the movement of the upper mold 601, and that the press ram 54 is at the operation initial position can be understood as that the upper mold 601 is at the operation initial position, for example.

As shown in FIG. 4 and FIG. 5, first, a starting instruction is provided and then a predetermined number of pulse signals are provided from the pulse generating unit 901 to the servo motor 51, the servo motor 51 rotates in correspondence with the number of pulse signals, and the press ram 54 at the operation initial position starts moving (descending). (Step S1)

At this time, the pulse signals become faster with increasing speed, and the moving speed of the press ram 54 is also accelerated. (Step S2) This state is shown as the region R1 in FIG. 6. In the region R1, the press load, i.e. the motor torque value rapidly increases due to the inertia at the time when the servo motor 51 starts moving, but it attains a constant value soon.

Attaining a predetermined speed, the press ram 54 performs high speed movement (descend) while maintaining that speed. (Step S3) This state is shown as the region R2 in FIG. 6. In the region R2, the press load of the servo motor 51 is maintained at a somewhat decreased state because the acceleration is finished.

When the press ram 54 reaches a predetermined position by the high speed movement, it starts decelerating operation. (Step S4) This state is shown as the region R3 in FIG. 6. In the region R3, the press load of the servo motor 51 further decreases due to the inertia of the press ram 54 in decelerating.

When it is recognized that the press ram 54 has decelerated to attain a predetermined speed, i.e. the mold clamping speed (about 1/100 of that in the high speed movement) and reached a predetermined position (Step S5), it moves (descends) while maintaining that speed in accordance with an instruction from the CPU unit 906 (Step S6), and the forming operation is started when it reaches a forming operation starting position (Step S7). The press load, i.e. the press load of the servo motor 51 increases as the upper mold 601 comes in contact with the processed object and the forming operation progresses. This state is shown as the region R4 in FIG. 6. In the region R4, the press load is constant after the deceleration is finished and until the upper mold 601 comes in contact with the processed object. The forming operation starting position is set to a position immediately before the upper mold 601 and the lower mold 602 come in contact with the processed object to reduce the press operation time as short as possible.

When the forming operation is started, the voltage value of the servo motor 51 is always monitored in the CPU unit 906 through the AD converter unit 903 in the control device 90 to detect the press load of the servo motor 51, i.e., the torque value of the motor. It is previously known that the voltage and the torque value of the servo motor 51 have such correlation as shown in FIG. 3. A certain press load which is set as a detection press load in advance is input in the CPU unit 906, and the current press load (the current torque value) provided from the servo driver 80 and the detection press load (the detection torque value) provided from the CPU unit 906 through the DA converter unit 904 are compared with each other in the comparator unit 905. (Step S8)

At this time, if the current press load has not reached the detection press load yet, the mold clamping speed is maintained and the forming operation is continued, but if the current press load has reached the detection press load, the comparator unit 905 outputs an H/W (hardware) interruption signal.

The H/W interruption is means for operating interruption program input in the CPU unit 906 by generating signal from the comparator unit 905, for example, since interruption operation by software can not instantly deal with an argent interruption operation.

Specifically, while the processing to the processed object is controlled by monitoring the press load before the H/W interruption, the controlling method is changed after the H/W interruption as follows; with data obtained by measuring the correlation between the amount of movement A (an amount which is converted with the number of pulses provided to the servo motor 51 and is in proportion to the driving quantity of the servo motor 51) of the press ram 54 and the torque value (press load) of the servo motor 51 when pressing a reference frame, i.e., a processed object with a standard thickness, a lead frame of a semiconductor device herein, previously input in the CPU unit 906, the amount of movement A from the detection press load (detection torque value) to a predetermined target press load (target torque value) is calculated, and the processing to the processed object is controlled by monitoring the number of pulses of the motor 51 until the calculated amount of movement A is reached.

Now, the press ram 54 is decelerated until the calculated movement amount A is achieved and the speed of the press ram 54 perfectly attains zero (stops) at the time when the movement amount A is achieved. This operation additionally clamps the processed object. (Step S9) The position where the speed of the press ram 54 perfectly attains zero is referred to as a lower dead point (target stop position).

This state is shown as the region R5 in FIG. 6. In the region R5, deceleration is started at the time when the H/W interruption is made and the speed perfectly attains zero at the time when the movement amount A is reached, that is, at the time when the target press load (target torque value) is achieved.

As the movement amount A is previously set and the initial speed at which the deceleration is started is a certain mold clamping speed (about 1/100 of that in the high speed movement), decelerating pattern can be set in advance, and the deceleration control of the press ram 54 in the region R5 can be executed easily according to this decelerating pattern. The decelerating pattern is set as a function of the movement amount of the press ram 54 (the driving amount of the servo motor 51) and the speed, and the decelerating process in the Step S9 is achieved by controlling the servo motor 51 by comparing the movement amount of the press ram 54, i.e., the number of pulses provided to the servo motor 51 to the decelerating pattern every moment in the CPU unit 906 and outputting speed control signal (speed instructions) to provide speed corresponding to the movement amount.

Although the decelerating pattern shown in FIG. 6 is linear, the decelerating pattern may be like a sine curve so that the speed of the press ram 54 perfectly attains zero at the time when backlash etc. are cancelled and the movement amount A is achieved. As long as it can perfectly reach zero when the target press load is achieved, the decelerating pattern does not necessarily have to be a sine curve, but it may be deceleration like a quadratic curve, or may be deceleration like a cam curve such as a cycloid curve.

This way, the method of controlling the processing of objects by monitoring the movement amount of the press ram 54 is advantageous in that constant press load can always be applied even to objects with thickness out of standard, e.g., lead frames of semiconductor devices which are thicker than a reference frame (referred to as a thick frame) or which are thinner than that (referred to a thin frame), herein.

The lead frames of the semiconductor device have difference in thickness because plating for soldering generally applied to the lead frames have differences in thickness from 10 to 20 μm.

Figure 7:
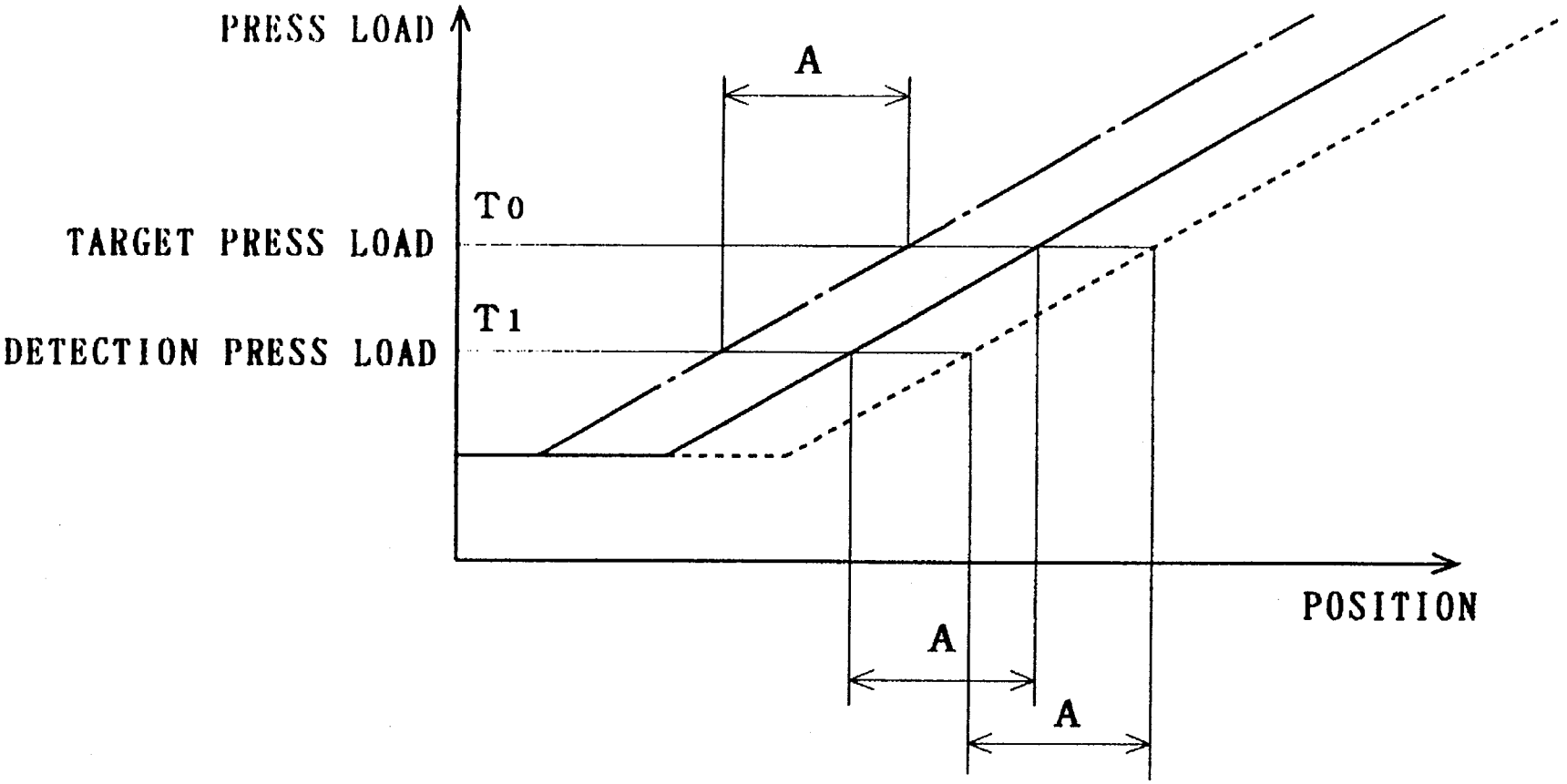
FIG. 7 is a diagram showing the correlation between the position of the press ram and the press load of the servo motor when pressing a lead frame.

FIG. 7 shows the correlation between the position of the press ram 54 and the torque value (press load) of the servo motor 51 when pressing a reference frame, a thick frame and a thin frame. As shown in FIG. 7, although the detection press load T1 is reached on the upstream side in the case of the frame thicker than the reference frame and is reached on the downstream side in the case of the thinner frame, the inclinations before they reach the target press load (target torque value) TO from the detection press load (detection torque value) are almost the same, so that the movement amounts A of the press ram 54 are also almost the same, and constant press load can be exerted irrespective of the variation in thickness by monitoring the movement amount of the press ram 54. It is also possible to apply constant press load when the shut heights (the height of the upper mold 601 when the upper mold 601 and the lower mold 602 are in contact with each other) differ, when the mold 60 is exchanged, for example, with the same principle.

Next, the comparator unit 905 compares the current press load (torque value) applied from the servo driver 80 and the target press load (target torque value) applied from the CPU unit 906 through the DA converter unit 904 at the time when the press ram 54 attains the calculated movement amount A. (Step S10)

At this time, if the current press load (torque value) has reached the target press load (target torque value), it is determined that the press work of the processed object has been finished. (Step S11)

Subsequently, as the press ram 54 returns (ascends) to the operation initial position, the movement amount to the operation initial position can easily be calculated (Step S12) because the number of pulses applied to the servo motor 51 as the press ram 54 moves from the operation initial position to the lower dead point is integrated in the CPU unit 906 through the pulse counter unit 902, so that the return to the operation initial position can be achieved correctly.

Now, the pulse resolution of the servo motor 51 is extremely high, and the stopping accuracy of the press ram 54 is within ±1 pulse, and the movement stopping accuracy of the press ram 54 at this time is very high as 0.1 μm or below.

After calculating the amount of movement to the operation initial position, it moves (ascends) while accelerating to a predetermined speed (Step S13), stops accelerating at the time when the predetermined speed is achieved, moves at high steed (ascends) while maintaining the predetermined speed (Step S14), moves (ascends) while decelerating (Step S15), stops decelerating at the time when a predetermined speed is reached, and continues moving (ascending) while maintaining that speed (Step S16). Here, the speed at which the decelerating is stopped is referred to as a position correction speed, which is set to be about 1/100 of that in the high speed movement.

The press ram 54 continues going up at the position correction speed, and when the position detecting device 56 senses the magnetic field produced by the magnet 544 to attain an ON state, i.e., when it detects the position of the press ram 54 (Step S17), it stops at the operation initial position (Step S18). The position correction speed which is determined in consideration of the reaction speed and the resolution of the position detecting device 56 may be faster or slower than 1/100 of that in the high speed movement.

Here, when the magnetic sensor senses the magnetic field produced by the moving magnet 544 and converts it into a voltage, the maximum voltage is not outputted at first, but the outputted voltage has distribution due to the form of the magnetic field of the magnet 544, the sensing ability of the magnetic sensor, and the like. The distribution characteristic is bell-shaped, and it is determined that the position detecting device 56 has attained an ON state when a certain voltage value, as a threshold value is reached. The threshold value is set to a value of 70%–80% of the maximum current, for example.

<3-3. Control Operation in Abnormal State>

In step S10, if it is determined that the current press load (torque value) has not attained the target press load (target torque value), the CPU unit 906 determines that an error is occurring (Step S19), and returns the press ram 54 to the origin. (Step S20) The press ram 54 which has returned to the origin performs position correction operation (Step S21) to return to the operation initial position and repeats the operation in and after the Step S2.

In the Step S17, if the position detecting device 56 does not attain an ON state, the press ram 54 continues ascending at the position correction speed until the position detecting device 56 attains an ON state.

<3-4. Positional Correction After Returning to the Origin>

Figure 8:
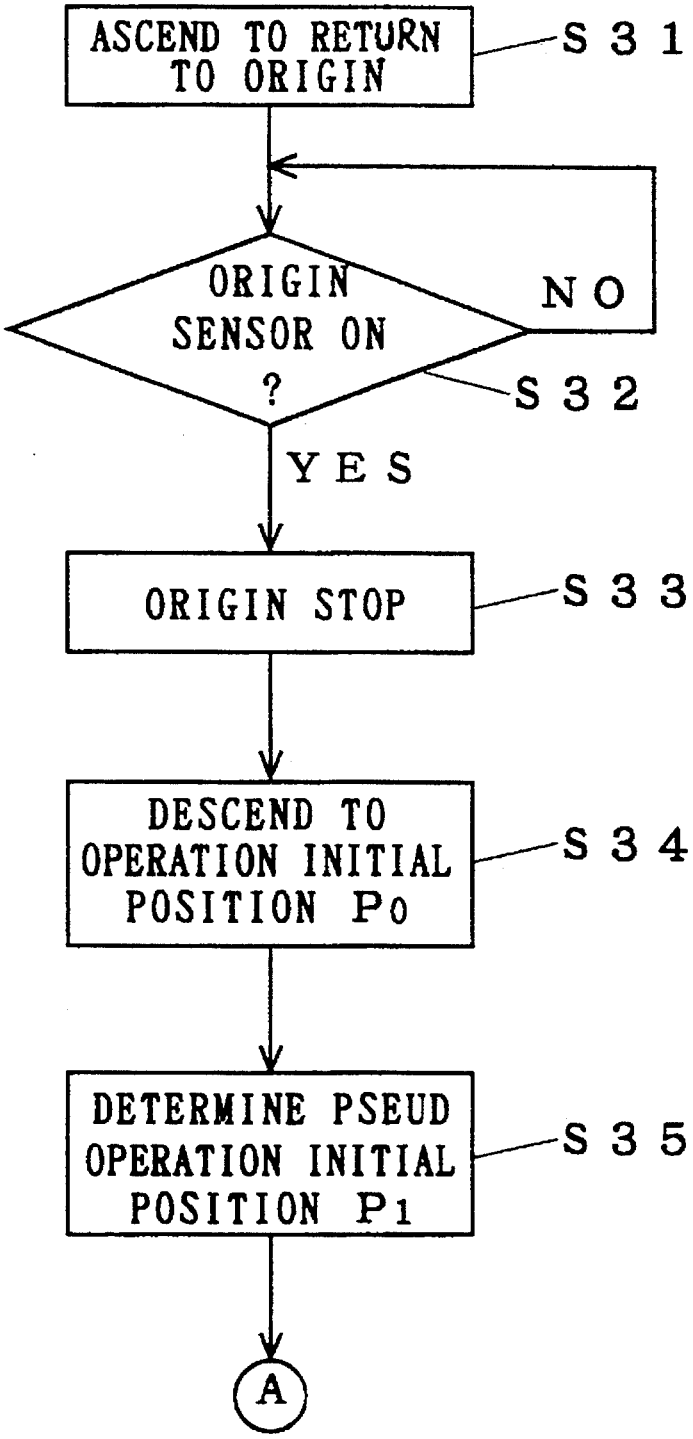
FIG. 8 is a flow-chart for illustrating the press control method according to the present invention.
Figure 9:
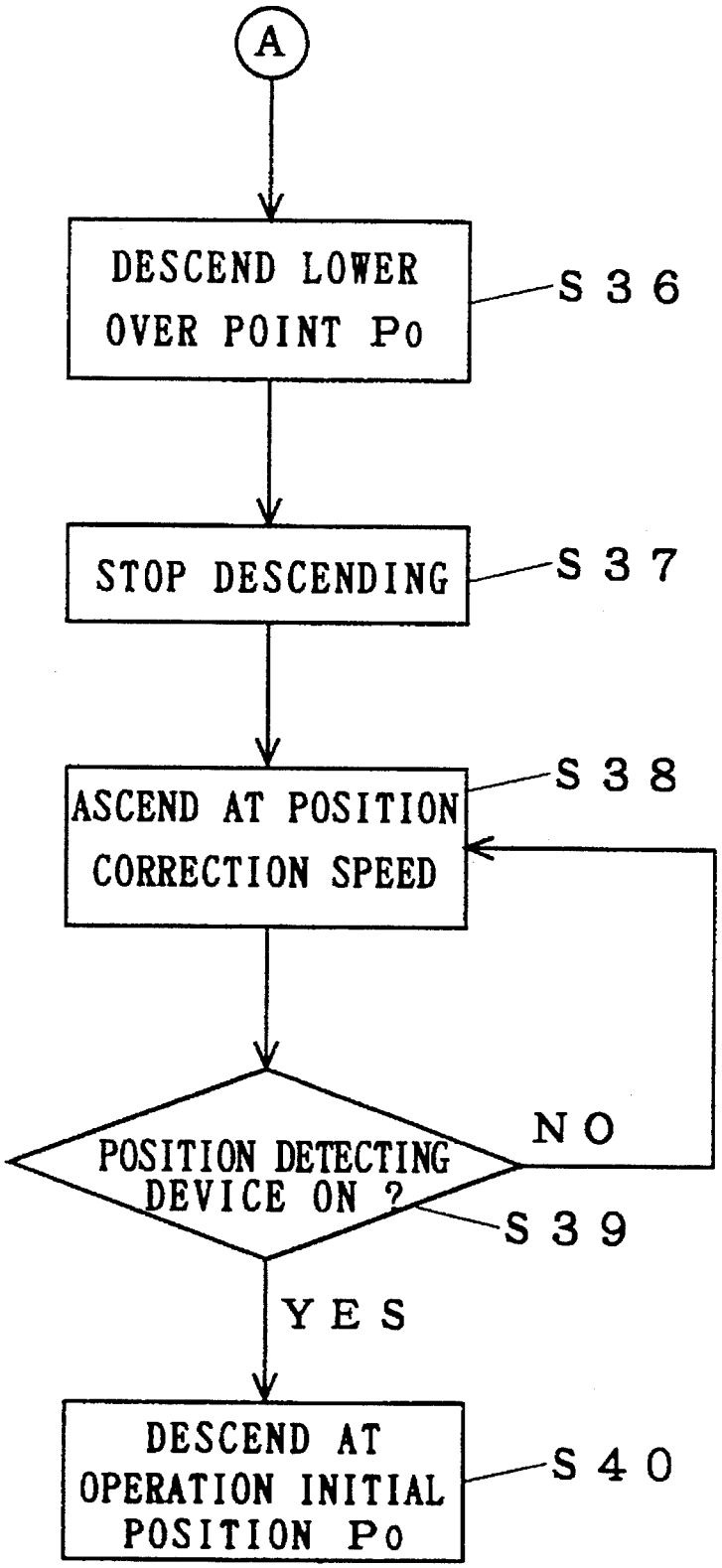
FIG. 9 is a flow-chart for illustrating the press control method according to the present invention.
Figure 10:
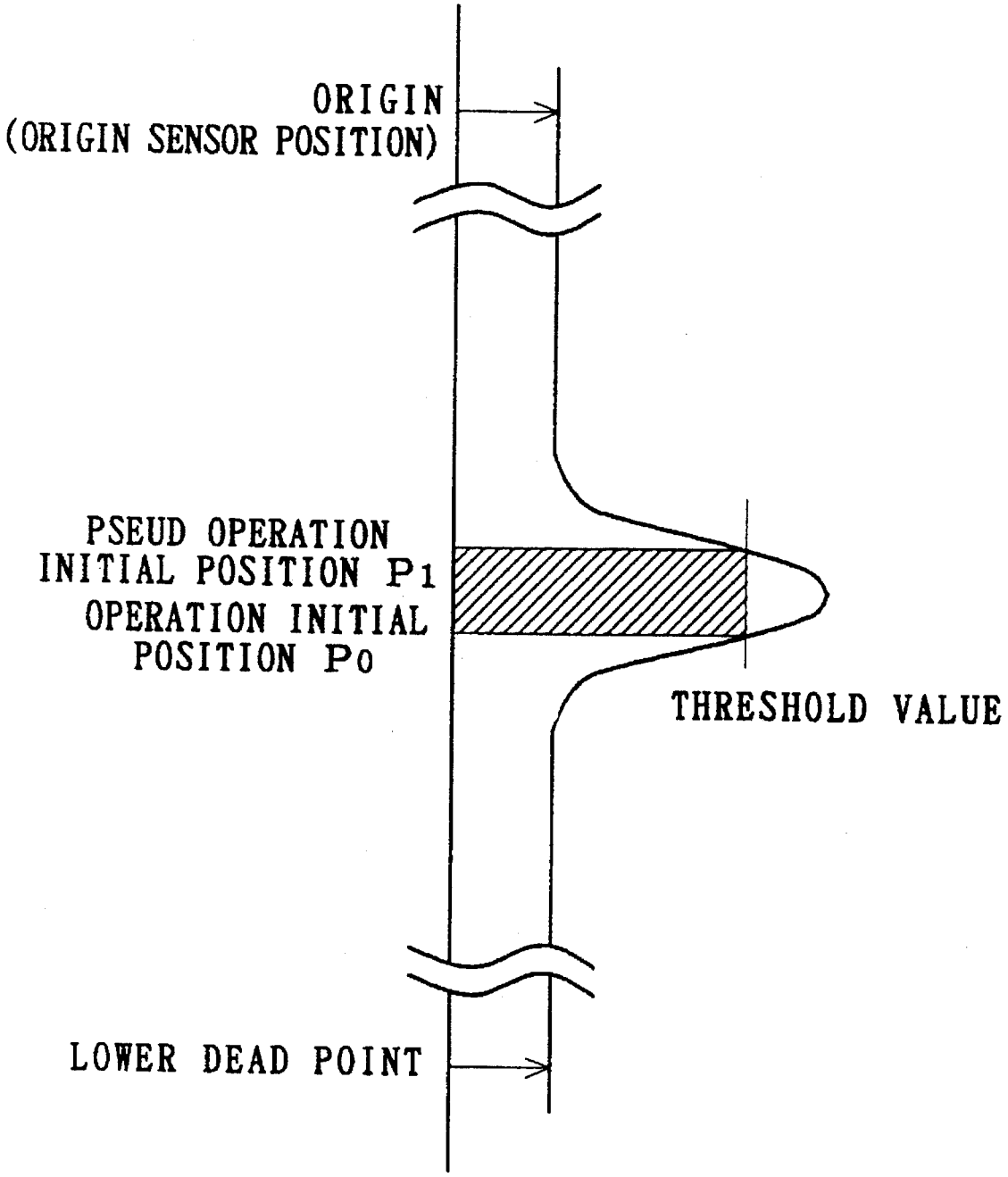
FIG. 10 is a diagram for illustrating the press control method according to the present invention.

Next, positional correction after the press ram 54 has returned to the origin will be described referring to FIG. 8, FIG. 9 and FIG. 10. FIG. 8 and FIG. 9 show a flow chart of positional correction operation after the return to the origin. As shown in the Step S31 in FIG. 8, the press ram 54 ascends to return to the origin. When the origin detecting device 57 (origin sensor) turns ON and it is recognized that the press ram 54 has returned to the origin (Step S32), the press ram 54 stops once at the origin (Step S33).

Next, it starts descending toward the operation initial position in the Step S34. Now, the output distribution characteristic of the magnetic sensor is shown in FIG. 10. In FIG. 10, the origin (upper dead point) and the lower dead point are shown as well as the distribution characteristic at the operation initial position (home position) to clearly show the positional relation. In the bell-shaped distribution characteristic, the threshold value is achieved at two positions, and one on the downstream side is shown as an operation initial position $P_0$, and one on the upstream side is shown as a pseudo operation initial position $P_1$.

The press ram 54 going down toward the operation initial position first reaches the pseudo operation initial position $P_1$, which is fed back to the CPU unit 906. (Step S35)

As shown in FIG. 9, the press ram 54 does not stop at the pseudo operation initial position $P_1$ and continues going down (Step S36), and stops at a position lower than the operation initial position $P_0$ (Step S37). The stopping position after passing the operation initial position $P_0$ is set with the number of pulses applied to the servo motor in advance, for example.

Next, the press ram 54 goes up at the position correction speed (Step S38) to reach the operation initial position $P_0$, and when the CPU unit 906 recognizes that the position detecting device 56 has attained an ON state (Step S39), the press ram 54 stops (Step S40). This operation correctly returns the press ram 54 to the operation initial position from the origin (the upper dead position).

Now, in the step S32, if it is not recognized that the press ram 54 has returned to the origin, the press ram 54 continues going up until returning to the origin, and if it is not recognized in the Step S39 that the position detecting device 56 has attained an ON state, it continues going up at the position correction speed until it returns to the operation initial position.

The operation of the press ram 54 for returning to the origin is performed not only when it is determined that the current press load (torque value) has not attained the target press load (target torque value) in the step S10 shown in FIG. 4, but also when the current position of the press ram 54 is lost because of abnormal condition, such as failure of power supply etc.

In the press apparatus according to the present invention described above, molds are exchanged depending on shape and thickness of lead frames so that it can process various kinds of lead frames of semiconductor devices. Accordingly, press working conditions such as the press load, the mold clamping speed, the forming operation starting position, etc. differ for different molds. Hence, it is a matter of course that press working conditions suitable for respective molds are input in the control device 90 in advance so that the press working conditions can be automatically selected depending on types of the semiconductor devices.

Although the description has been made on the press apparatus according to the present invention with the structure in which the press ram 54 is connected to the lower end of the screw shaft 53 and the shank 541 is provided in the center of the lower end of the press ram 54 as shown in FIG. 1, the shank 541 may be directly attached to the lower end of the screw shaft 53 without through the press ram 54. Then, the driving mechanism is more shortened and simplified, and mechanical loss such as backlash can be suppressed more.

Although the description above has been made on pressing lead frames of semiconductor devices, it goes without saying that the press apparatus according to the present invention can be used not only in processing of lead frames, but also for various press processings which require processing accuracy.

<4. Modified Example>

Although the press device according to the present invention has been described in an example in which a servo motor is used as a press load generating source, a linear motor with linear rotor and stator may be used instead of the servo motor. As the linear motor can directly obtain a linear driving force (thrusting force), mechanism for converting the rotational force into a linear driving force (thrusting force) is not needed and the structure is more simplified, and which will provide further suppression of mechanical loss, such as backlash.

While the invention has been described in detail, the foregoing description is in all aspects illustrative and not restrictive. It is understood that numerous other modifications and variations can be devised without departing from the scope of the invention.

We claim:

1. A press control method for a press apparatus which converts a driving force of a motor into a thrusting force of a mold through driving force—thrusting force converting means directly connected to said motor to press a processed object, comprising the steps of:

(a) detecting a change of a torque value of said motor attendant on press processing of said processed object and determining whether a previously set predetermined torque value smaller than a target rated torque value is reached or not; and (b) after reaching said predetermined torque value, counting the quantity of drive of said motor, comparing deceleration pattern which is previously set as a function of speed and the quantity of drive and the counted quantity of drive of said motor and decelerating thrusting speed of said mold on the basis of a speed instruction applied according to the quantity of drive of said motor so that the thrusting speed of said mold attains zero at the time when the quantity of drive of said motor achieves a previously set predetermined quantity of drive.

2. The press control method according to claim 1, wherein said deceleration pattern is a sine curve.

3. The press control method according to claim 1, wherein said predetermined quantity of drive is the quantity of drive of said motor made while the torque value of said motor reaches said rated torque value from said predetermined torque value, and which is a value for pressing ones with standard thickness in said processed objects having variation in thicknesses.

4. The press control method according to claim 1, further comprising after said step (b) the step of, (c) returning said mold to an initial position;

said step (c) including the steps of, decelerating the thrusting speed of said mold to predetermined speed before said mold reaches said initial position, and stopping said mold at the time when the position of said mold moving at said predetermined speed is detected by initial position detecting means provided in said press apparatus.

5. The press control method according to claim 4, further comprising the step of suppressing temperature rise of said driving force—thrusting force converting means caused in press processing of said processed object in parallel with said steps (a)–(c).

6. The press control method according to claim 4, wherein said processed object is a lead frame which works as a terminal of a semiconductor device with a resin sealed semiconductor integrated circuit.

7. A press apparatus which converts a driving force of a motor into a thrusting force of a mold through driving force—thrusting force converting means directly connected to said motor to press a processed object, comprising:

torque value detecting means connected to said motor, for detecting a change of a torque value of said motor caused in press processing of said processed object;

torque value comparing means connected to said torque value detecting means, for making a comparison and determining whether the detected torque value is a previously set predetermined torque value which is smaller than a target rated torque value or not;

drive quantity counting means connected to said motor for counting the quantity of drive of said motor; and controlling means connected to said torque value comparing means and said drive quantity counting means, for storing deceleration pattern previously set as a function of speed and the quantity of drive and comparing the quantity of drive of said motor outputted from said drive quantity counting means and said deceleration pattern to output speed instructions according to the quantity of drive of said motor so as to decelerate the thrusting speed of said mold, so that after reaching said predetermined torque value, the thrusting speed of said mold attains zero at the time when the quantity of drive of said motor achieves a previously set predetermined quantity of drive.

8. The press apparatus according to claim 7, further comprising initial position detecting means connected to said controlling means, for detecting whether said mold is at an initial position or not and feeding it back to said controlling means.

9. The press apparatus according to claim 7, wherein said driving force—thrusting force converting means has a thrusting shaft for providing a thrusting force to said mold, said mold being disposed on its center line, and said press apparatus further comprises temperature rise suppressing means for spraying gas maintained at a certain temperature to said thrusting shaft to suppress temperature rise of said driving force—thrusting force converting means.

10. The press apparatus according to claim 7, wherein said motor is a torque motor which is driven by a pulse signal.

11. The press apparatus according to claim 8, wherein said initial position detecting means has a magnetic sensor sensing a magnetic force to sense magnetic field generated by a magnet provided to move as said mold moves to detect that said mold is at the initial position.

12. The press apparatus according to claim 8, wherein said initial position detecting means has an optical sensor having a light emitting portion and a light receiving portion for outputting a detection signal when light from said light emitting portion incident on said light receiving portion is interrupted, to detect that said mold is at the initial position as shielding means provided to move as said mold moves interrupts the light from said light emitting portion.

* * * * *